US006278408B1

(12) United States Patent
Segovia, Jr.

(10) Patent No.: US 6,278,408 B1
(45) Date of Patent: Aug. 21, 2001

(54) VEHICLE ANTENNA DISPLAY SYSTEM

(76) Inventor: Eugenio Segovia, Jr., 205 Heritage Trail North, Bellville, TX (US) 77418

( * ) Notice: Subject to any disclaimer, the term of this patent is extended or adjusted under 35 U.S.C. 154(b) by 0 days.

(21) Appl. No.: 09/659,128

(22) Filed: Sep. 11, 2000

(51) Int. Cl.[7] ..... H01Q 1/32
(52) U.S. Cl. ..... 343/715; 343/711; 428/31
(58) Field of Search ..... 343/711, 712, 343/713, 715, 900; 428/31

(56) References Cited

U.S. PATENT DOCUMENTS 4,978,964 * 12/1990 Castille ..... 343/715
6,063,459 * 5/2000 Velte ..... 428/31
6,197,390 * 3/2001 LaVite ..... 428/31

* cited by examiner

*Primary Examiner*—Tan Ho
(74) *Attorney, Agent, or Firm*—Joseph N. Breaux

(57) ABSTRACT

A vehicle antenna display system that moves as the vehicle travels along. The vehicle antenna display system includes a slide member and a stop member. The slide member slides up and down the vehicle antenna depending on the speed of the vehicle by the force of the air generated by the moving vehicle against one or more wing portions. The lead edge of each wing portion is kept oriented into the blowing air by a tail member.

1 Claim, 4 Drawing Sheets

VEHICLE ANTENNA DISPLAY SYSTEM

TECHNICAL FIELD

The present invention relates to displays items that are adapted to be secured to the antenna of a vehicle and more particularly to a vehicle antenna display system for use on a vehicle antenna attached to a vehicle and extending upwardly from the vehicle terminating at a top antenna end; the vehicle antenna display system including an antenna slide member having an antenna slide tube having a tube diameter sufficient to be slidably positionable over the top antenna end of the vehicle antenna and a stop member having an antenna end attachment structure securable to the top antenna end of the vehicle antenna and sized larger than the tube diameter of the antenna slide tube; the antenna slide member including a wing portion intersected by the antenna slide tube at an angle "A" of greater than ten degrees and a tail member attached to the antenna slide tube along a side section of the antenna slide tube having a lowest portion of the wing portion in connection therewith; the tail member having sufficient wind resistance such that, when the antenna slide member is slidably installed over the end of a vehicle antenna, blowing air exerts a tail member force against the tail member sufficient to bias a leading edge portion of the wing member into the blowing air such that blowing air generates a lifting force against the wing portion sufficient to slide the antenna slide member upward along the vehicle antenna.

BACKGROUND ART

Individuals often enjoy providing displays on their vehicles such as bumper stickers, window flags, window decals and antenna displays. It would be a benefit, therefore, to have a vehicle antenna display system. Because the eye is drawn to movement, such as a waving flag, it would be further desirable if the vehicle antenna display system moved as the vehicle traveled along. As a further novelty it would also be desirable if the antenna display system included a sliding member that would slide up and down the vehicle antenna depending on the speed of the vehicle.

GENERAL SUMMARY DISCUSSION OF INVENTION

It is thus an object of the invention to provide a vehicle antenna display system for use on a vehicle antenna attached to a vehicle and extending upwardly from the vehicle terminating at a top antenna end; the vehicle antenna display system including an antenna slide member having an antenna slide tube having a tube diameter sufficient to be slidably positionable over the top antenna end of the vehicle antenna and a stop member having an antenna end attachment structure securable to the top antenna end of the vehicle antenna and sized larger than the tube diameter of the antenna slide tube; the antenna slide member including a wing portion intersected by the antenna slide tube at an angle "A" of greater than ten degrees and a tail member attached to the antenna slide tube along a side section of the antenna slide tube having a lowest portion of the wing portion in connection therewith; the tail member having sufficient wind resistance such that, when the antenna slide member is slidably installed over the end of a vehicle antenna, blowing air exerts a tail member force against the tail member sufficient to bias a leading edge portion of the wing member into the blowing air such that blowing air generates a lifting force against the wing portion sufficient to slide the antenna slide member upward along the vehicle antenna.

Accordingly, a vehicle antenna display system for use on a vehicle antenna attached to a vehicle and extending upwardly from the vehicle terminating at a top antenna end. The vehicle antenna display system including an antenna slide member having an antenna slide tube having a tube diameter sufficient to be slidably positionable over the top antenna end of the vehicle antenna and a stop member having an antenna end attachment structure securable to the top antenna end of the vehicle antenna and sized larger than the tube diameter of the antenna slide tube; the antenna slide member including a wing portion intersected by the antenna slide tube at an angle "A" of greater than ten degrees and a tail member attached to the antenna slide tube along a side section of the antenna slide tube having a lowest portion of the wing portion in connection therewith; the tail member having sufficient wind resistance such that, when the antenna slide member is slidably installed over the end of a vehicle antenna, blowing air exerts a tail member force against the tail member sufficient to bias a leading edge portion of the wing member into the blowing air such that blowing air generates a lifting force against the wing portion sufficient to slide the antenna slide member upward along the vehicle antenna.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
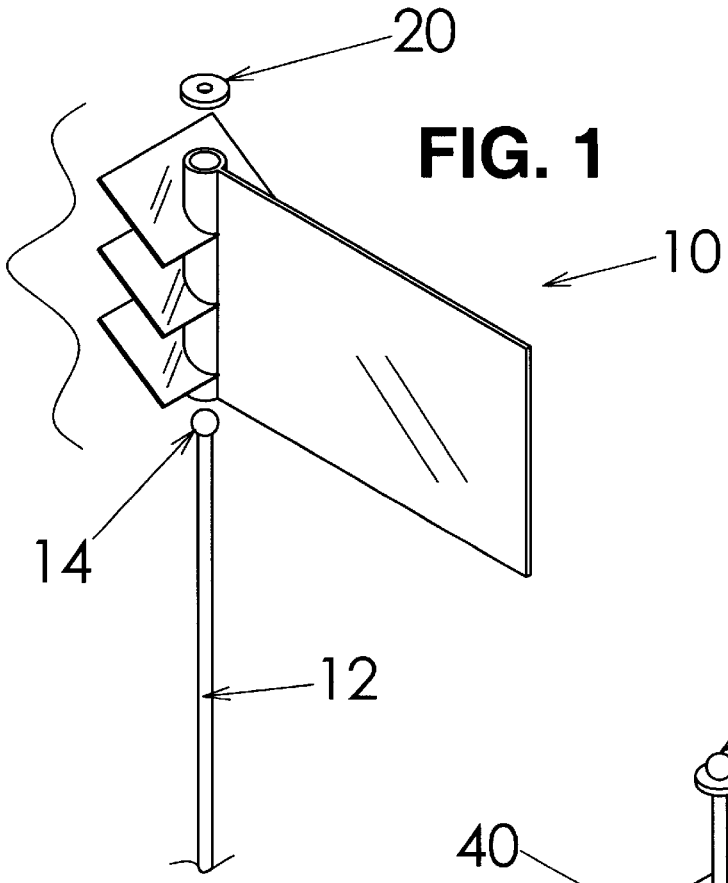
FIG. 1 is an exploded perspective view of an exemplary embodiment of the vehicle antenna display system and a portion of a representative vehicle antenna.
Figure 2:
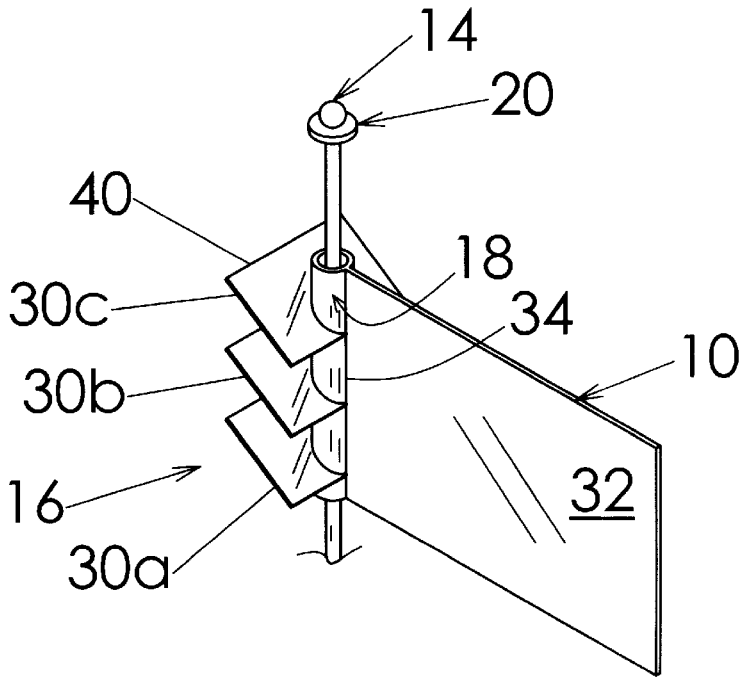
FIG. 2 is a perspective view of the vehicle antenna display system with the antenna slide tube of the antenna slide member slidably positioned over the top antenna end of the vehicle antenna and the resilient washer shaped stop member secured to the top antenna end of the vehicle antenna.
Figure 3:
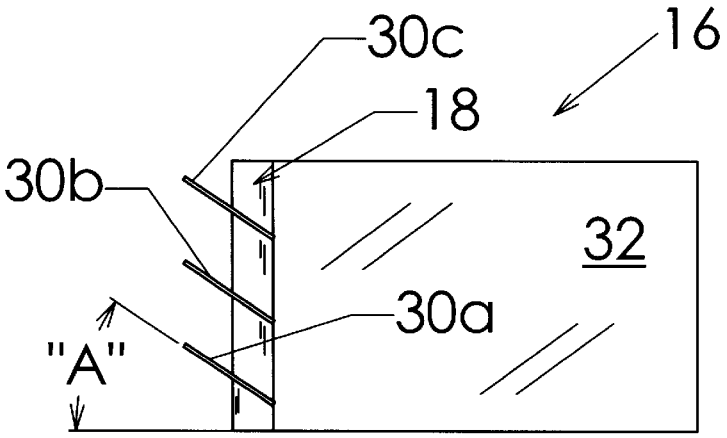
FIG. 3 is a side plan view of the antenna slide member showing the three wing portions intersecting the antenna slide tube at an angle "A" of forty-five degrees.
Figure 6:
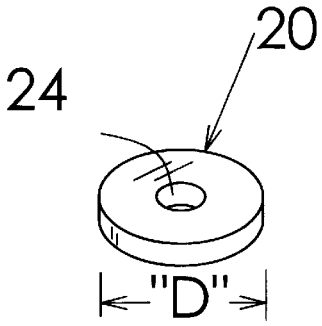
FIG. 6 is a perspective view showing the resilient washer shaped stop member with the antenna end gripping aperture provided through the center thereof.
Figure 4:
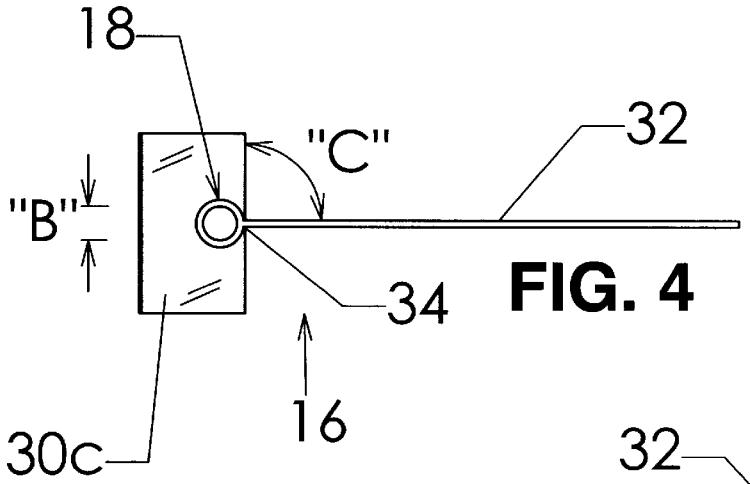
FIG. 4 is a top plan view of the slide member showing the slide tube diameter "B" and the ninety degree angle orientation "C" of the tail member with respect to the leading edge of the wing portion.
Figure 5:
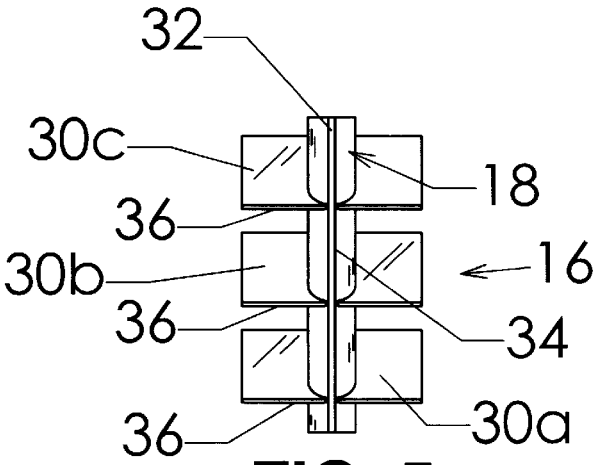
FIG. 5 is a front plan view of the antenna slide member showing the three wing portions.
Figure 7:
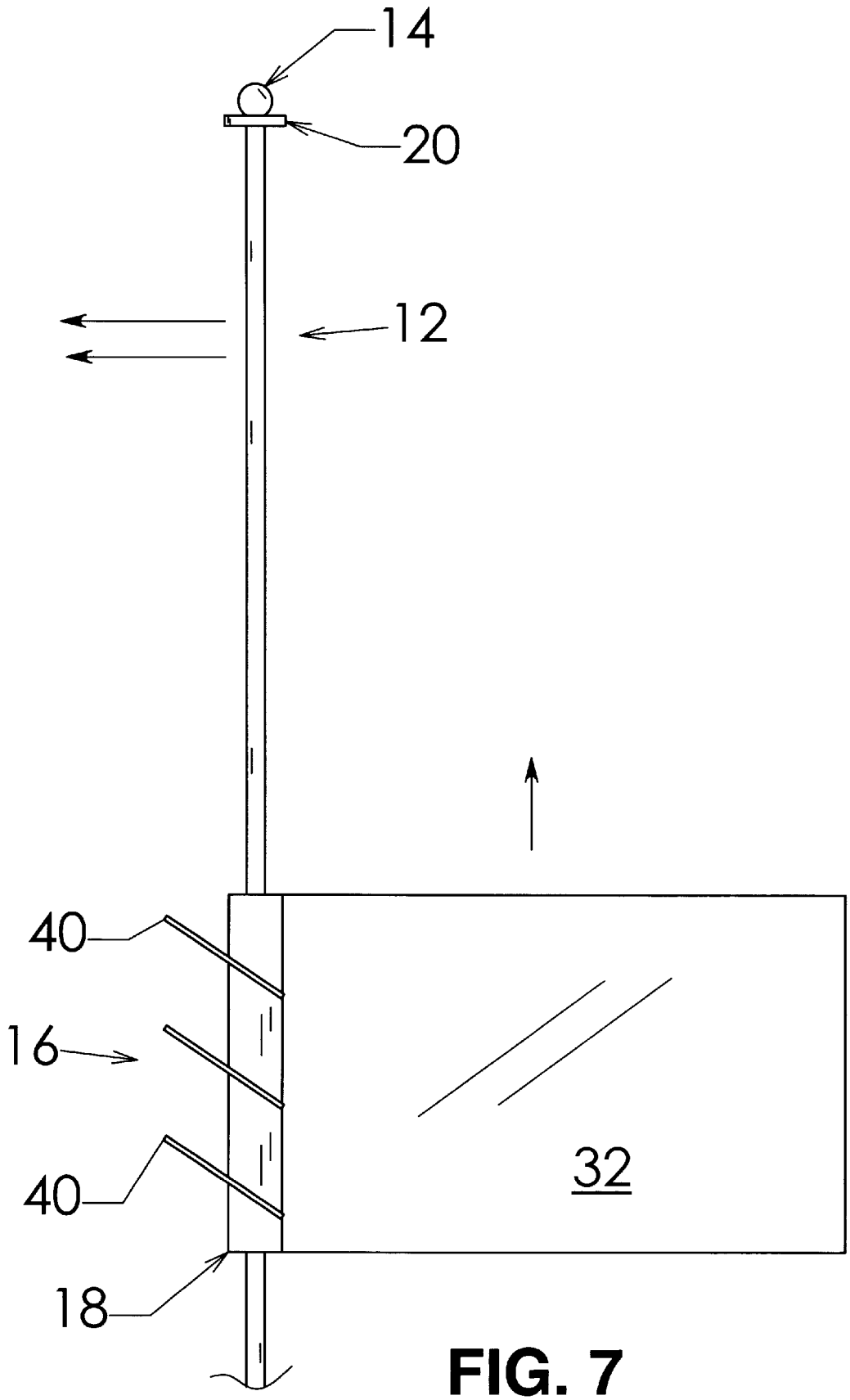
FIG. 7 is a side plan view showing the antenna slide member in a low position along the vehicle antenna.
Figure 8:
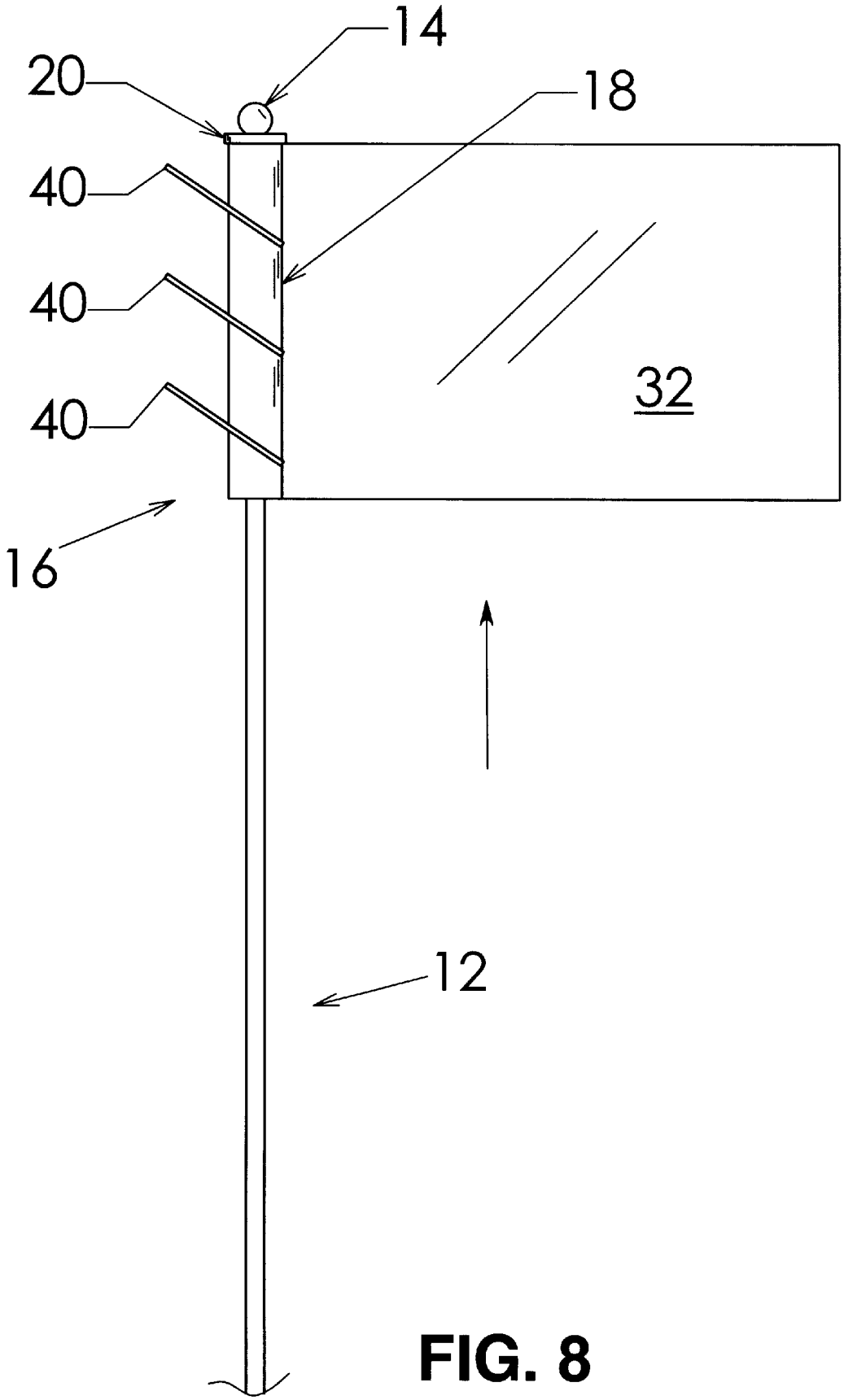
FIG. 8 is a side plan view showing the antenna slide member at its highest position on the vehicle antenna.

FIGS. 1–8 show various aspects of an exemplary embodiment of the vehicle antenna display system of the present invention generally designated 10. Vehicle antenna display system 10 is constructed for use on a vehicle antenna, generally designated 12, attached to a vehicle and extending upwardly from the vehicle terminating at a top antenna end 14. Vehicle antenna display system 10 includes an antenna slide member, generally designated 16, having an antenna slide tube, generally designated 18, with a tube diameter "B" (FIG. 4) sufficient to be slidably positionable over top antenna end 14 of vehicle antenna 12; and a resilient washer-shaped stop member, generally designated 20 having antenna end gripping aperture 24 provided through the center thereof that functions as the antenna end attachment structure. Antenna end gripping aperture is deformably positioned into gripping connection with top antenna end 14 of vehicle antenna 12. Washer-shaped stop member 20 had an outside diameter "D" sized larger than the tube diameter "B" of antenna slide tube 18.

In this exemplary embodiment, antenna slide member 16 includes three parallel oriented wing portions 30*a–c* that are intersected by antenna slide tube 18 at an angle "A" of forty-five degrees and a tail member 32 attached to the antenna slide tube 18 along a side section 34 of the antenna slide tube 18 having a lowest portion 36 of wing portions 30*a–c* in connection therewith. Tail member 32 is constructed of a stiff flexible plastic sheet having sufficient wind resistance such that, when antenna slide member 16 is slidably installed over top antenna end 14 of a vehicle antenna 12, blowing air, generated as the vehicle moves, exerts a tail member force against tail member 32 sufficient to bias a leading edge portion 40 of the wing members 30*a–c* into the blowing air such that the blowing air generates a lifting force against the wing portions 30*a–c* sufficient to slide antenna slide member 16 upward along vehicle antenna 12. If desired tail member 32 may be printed with designs logos or advertising on one or both sides thereof.

It can be seen from the preceding description that a vehicle antenna display system has been provided.

It is noted that the embodiment of the vehicle antenna display system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A vehicle antenna display system for use on a vehicle antenna attached to a vehicle and extending upwardly from the vehicle terminating at a top antenna end; said vehicle antenna display system comprising:

an antenna slide member having an antenna slide tube having a tube diameter sufficient to be slidably positionable over the top antenna end of the vehicle antenna; and a stop member having an antenna end attachment structure securable to the top antenna end of the vehicle antenna and sized larger than the tube diameter of the antenna slide tube;

the antenna slide member including a wing portion intersected by the antenna slide tube at an angle of greater than ten degrees and a tail member attached to the antenna slide tube along a side section of the antenna slide tube having a lowest portion of the wing portion in connection therewith;

the tail member having sufficient wind resistance such that, when the antenna slide member is slidably installed over the end of a vehicle antenna, blowing air exerts a tail member force against the tail member sufficient to bias a leading edge portion of the wing member into the blowing air such that blowing air generates a lifting force against the wing portion sufficient to slide the antenna slide member upward along the vehicle antenna.

* * * * *